US008118695B2

(12) United States Patent
Sutherland et al.

(10) Patent No.: US 8,118,695 B2
(45) Date of Patent: Feb. 21, 2012

(54) ARROW FLETCHING

(75) Inventors: Warren E. Sutherland, Louisa, KY (US); Roy G. Mollette, Tomahawk, KY (US)

(73) Assignee: Inspired and Created Concepts, LLC, Louisa, KY (US)

( * ) Notice: Subject to any disclaimer, the term of this patent is extended or adjusted under 35 U.S.C. 154(b) by 1184 days.

(21) Appl. No.: 11/039,531

(22) Filed: Jan. 19, 2005

(65) Prior Publication Data

US 2005/0178375 A1 Aug. 18, 2005

Related U.S. Application Data

(60) Provisional application No. 60/537,639, filed on Jan. 20, 2004.

(51) Int. Cl.
*F42B 6/06* (2006.01)

(52) U.S. Cl. ..... 473/586

(58) Field of Classification Search ..... 473/578, 473/585, 586

See application file for complete search history.

(56) References Cited

U.S. PATENT DOCUMENTS

| | | | | | |
|---|---|---|---|---|---|
| 2,830,818 | A * | 4/1958 | Otto | ..... | 473/586 |
| 3,815,916 | A * | 6/1974 | Meszaros | ..... | 473/586 |
| 4,204,307 | A * | 5/1980 | Pfetzing | ..... | 29/407.09 |
| 4,234,192 | A * | 11/1980 | Salamone | ..... | 473/586 |
| 4,583,745 | A * | 4/1986 | Ladner | ..... | 473/586 |
| 5,427,385 | A * | 6/1995 | Conrad et al. | ..... | 473/586 |
| 5,443,272 | A * | 8/1995 | Vincent, Sr. | ..... | 473/578 |
| 5,443,273 | A * | 8/1995 | Lovorn | ..... | 473/586 |
| 5,613,688 | A | 3/1997 | Carella | | |
| 6,220,978 | B1 | 4/2001 | Schroeder | | |
| 6,641,493 | B1 * | 11/2003 | Shifflett | ..... | 473/578 |

* cited by examiner

*Primary Examiner* — John Ricci
(74) *Attorney, Agent, or Firm* — Emch, Schaffer, Schaub & Porcello, Co., L.P.A.

(57) ABSTRACT

The present invention is a shrinkable tube with pre-attached fletching with or without cresting. When heat is applied to the tube, it only takes seconds to shrink the tube to the arrow. The tube will shrink to a tight and secure fit on any size-hunting arrow. The fletching can be made with plastic vanes or feathers of any length, size or color. The shrinkable tube can be of any thickness or color or of any length, with or without cresting designs. This shrinkable fletching will allow hunters to fletch their own arrows in most situations. The situations where the shrink fletching can be used are unlimited as long as access to a proper heat source is available.

3 Claims, 5 Drawing Sheets

ARROW FLETCHING

CROSS REFERENCE TO RELATED APPLICATIONS

This application claims the benefit of U.S. provisional patent application Ser. No. 60/537,639 filed Jan. 20, 2004.

BACKGROUND OF THE INVENTION

The present invention is generally directed to an arrow-fletching concept. More particularly the fletching is designed to simplify and improve the process of arrow fletching by making arrow fletching quicker, more convenient and easier in any environment where boiling water or proper heat is available. The fletching and/or cresting are a one step process accomplished by shrinking the cylinder tube containing the fletching to the arrow shaft. Before the above-prescribed time, arrow fletching was done primarily in bow shops, stores, or in a hunter's workshop by the use of several pieces of equipment.

SUMMARY OF THE INVENTION

The present invention is directed to an arrow fletching invention having a hollow cylindrical, shrinkable tube. The tube has pre-attached fletching and/or cresting designs. By having the pre-attached fletching and/or cresting, fletching an arrow is simple and can be done in almost any situation. The tube is simply slid on an arrow shaft, and then heat, whether conventional or chemical, is applied to the shrinkable tube. The heat causes the tube to shrink to the arrow shaft which tightly and securely positions the fletching and/or cresting on the arrow. The shrink process can be used with or without glue, adhesives, tapes, or any other source of bonding material. The color, length and design of the fletching, whether straight or helical, can be varied to satisfy the shooter's personal preference with one size fitting most arrow sizes.

Other objects and advantages of the present invention will become apparent to those skilled in the art upon review of the following detailed description of the preferred embodiments and the accompanying drawings.

DETAILED DESCRIPTION OF THE PREFERRED EMBODIMENTS

The present invention is generally directed to an arrow-fletching concept. More particularly the fletching is designed to simplify the process of fletching and cresting an arrow. The features of the present invention will be more fully understood by referring to the attached drawings in connection with the following description.

Figure 1:
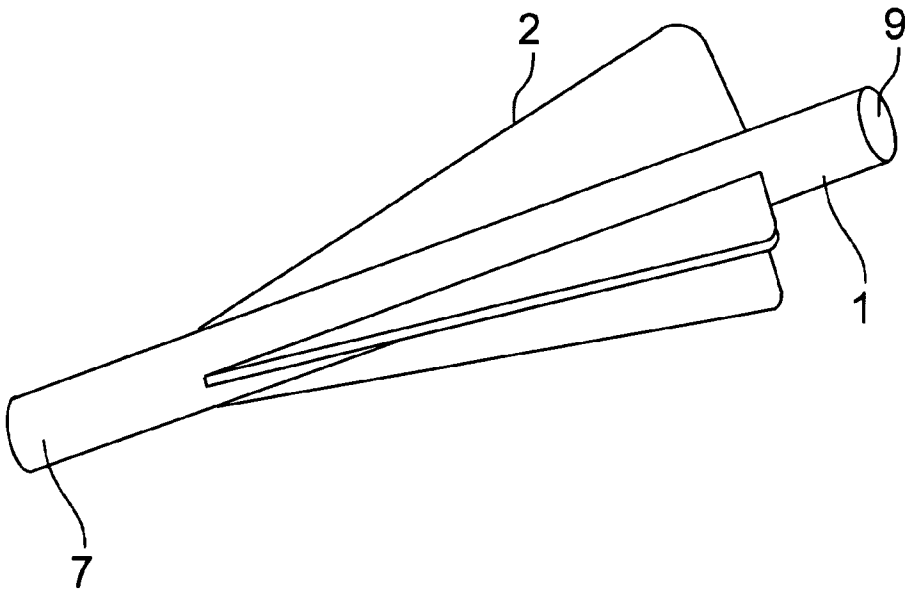
FIG. 1 is a perspective view of the fletching concept of the present invention with vanes attached.
Figure 2:
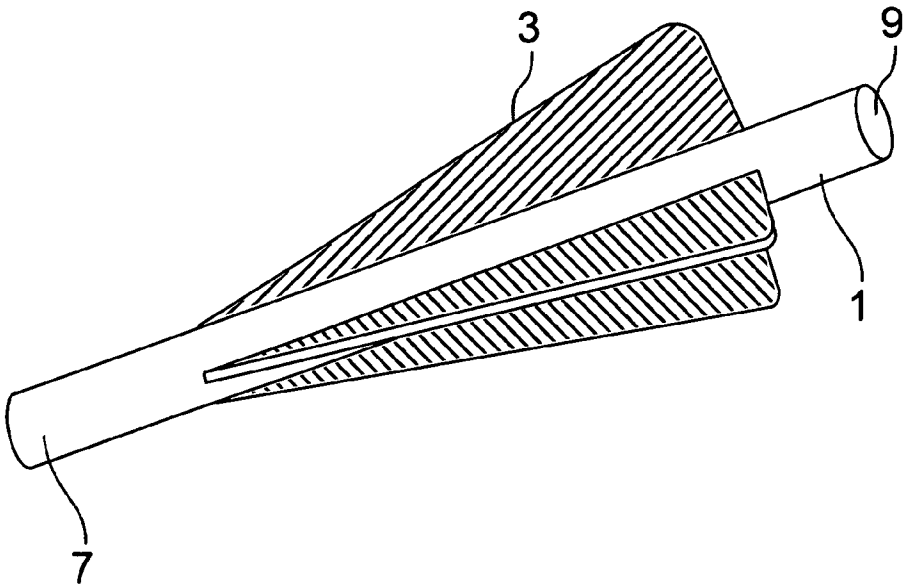
FIG. 2 is a perspective view of the fletching concept with feather fletching attached.
Figure 3:
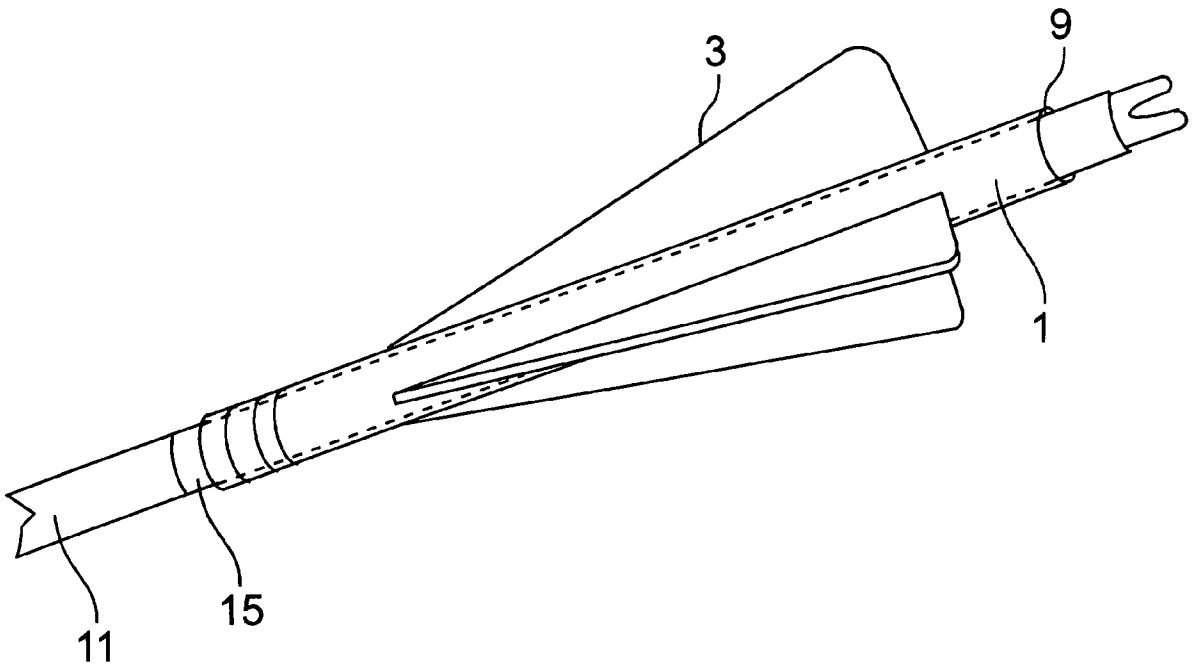
FIG. 3 is perspective view of the fletching concept positioned on an arrow shaft.
Figure 5:
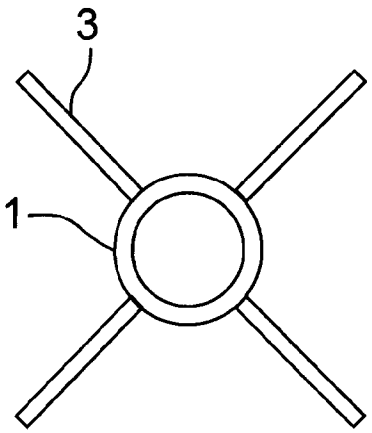
FIG. 5 is an end view of the heat shrinkable tube with four vanes or feathers attached.
Figure 4:
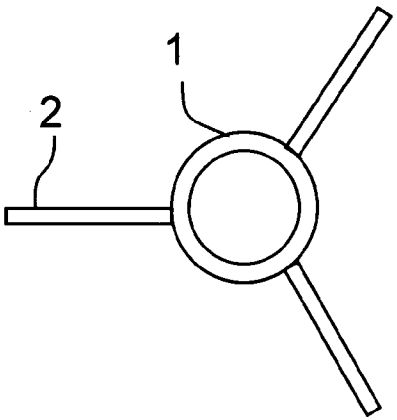
FIG. 4 is an end view of the heat shrinkable tube with three vanes or feathers attached.
Figure 6:
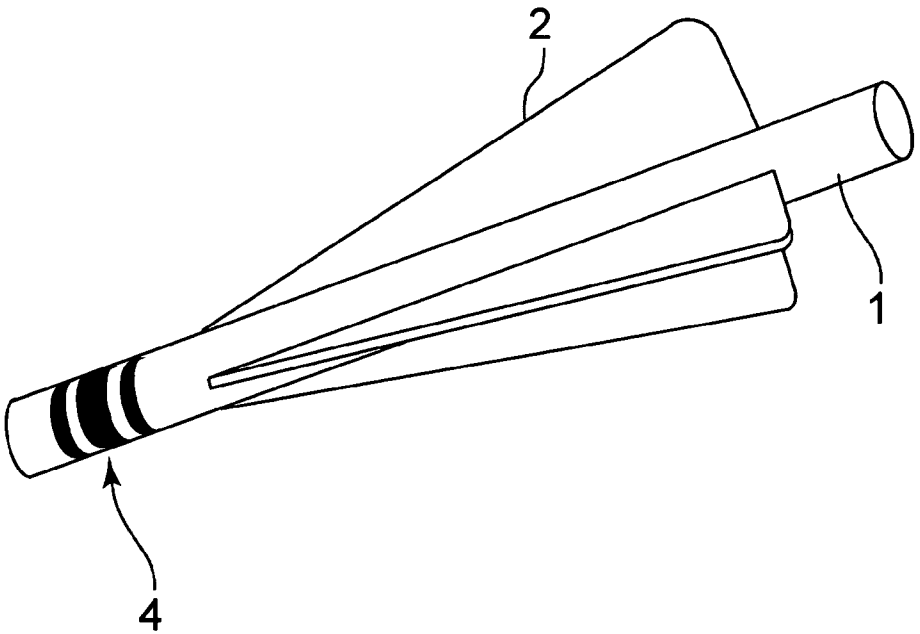
FIG. 6 is perspective view of fletching concept with cresting applied to the heat shrinkable tube.

This fletching concept uses a heat shrinkable cylindrical tube 1 having an exterior surface 7 and defining an interior passageway 9. Vanes 2 (FIG. 1) or feathers 3 (FIG. 2) are attached to the exterior surface 7 of the heat shrinkable tube 1. The heat shrinkable tube 1 can be made from polyolefin shrink tubing or other suitable heat shrinkable material. The shrink process can be used with or without glue, adhesives, tapes or any other bonding material. The heat shrinkable tube 1 with fletching attached is positioned over the end of the arrow 11 as shown in FIG. 3. The tube 1 is positioned on the arrow 11 as that the fletching is placed in the desired position on the arrow. The arrow 11 is positioned in the interior passageway 9 of the tube 1. The tube 1 shrinks when heated with the use of boiling water or another source of heat, conventional or chemical. As shown in FIG. 3 a bonding material 15 such as glue, adhesives or tape can be applied to the exterior surface of the arrow 11 to assist in securing the fletching to the arrow. The bonding material can be applied to the entire area of the arrow 11 where the tube 1 is positioned or just a portion of the area where the tube is positioned. The bonding material can be used to secure the tube 1 in the desired position on the arrow 11 until the tube is caused to shrink onto the arrow. The bonding material 15 can also be activated by the heating process that shrinks the tube 1 on the arrow 11. Various sizes, shapes and numbers of fletching vanes or feathers can be attached to the shrinkable tube 1 to produce an arrow with the desired characteristics. As shown in FIG. 4 there are three fletching vanes or there can be four attached vanes or feathers as shown in FIG. 5. The cylindrical tube 1 can be of different colors and can have cresting 4 of different designs as shown in FIG. 6. The flight of the arrow is aided when the shrinkable cylinder tube with fletching is applied.

The above description of the invention is given for explanatory purposes. Various modifications, changes and substitutions can be made without departing from the scope of the invention as defined by the following claims.

We claim:

1. A fletching for an arrow comprising:

a heat shrinkable tube having an exterior surface and defining an interior passageway, the interior passageway being designed to fit over the shaft of an arrow; and at least one vane positioned on the exterior surface of the tube, the at least one vane being positioned on the tube before the tube is placed over the shaft of an arrow, whereby heating the tube causes the tube and the fletching to bond to the shaft of the arrow, and wherein a bonding material is placed on the shaft of the arrow in the area where the tube is positioned whereby the bonding material holds the tube in the desired position on the arrow until the tube is heated to bond the tube to the arrow.

2. The fletching of claim 1 wherein the bonding material is positioned on only a portion of the shaft where the tube is positioned.

3. The fletching of claim 1 wherein the bonding material is activated by the heat that is applied to shrink the tube.

* * * * *